US006718575B1

(12) United States Patent
Lübeck et al.

(10) Patent No.: US 6,718,575 B1
(45) Date of Patent: Apr. 13, 2004

(54) UNDERSPRINGING ARRANGEMENT FOR MATTRESSES OR THE LIKE AND USE THEREOF

(75) Inventors: Felix Lübeck, Stade (DE); Klaus Jansen, Buxtehude (DE)

(73) Assignee: Thomas Hilfen Hilbeg GmbH & Co. Kommanditgesellschaft, Bremervorde (DE)

( * ) Notice: Subject to any disclaimer, the term of this patent is extended or adjusted under 35 U.S.C. 154(b) by 0 days.

(21) Appl. No.: 09/663,983

(22) Filed: Sep. 19, 2000

(51) Int. Cl.[7] ..... A47C 23/06
(52) U.S. Cl. ..... 5/236.1; 5/238; 5/201
(58) Field of Search ..... 5/236.1, 237, 238, 5/200.1, 201

(56) References Cited

FOREIGN PATENT DOCUMENTS

| | | | |
|---|---|---|---|
| CH | 491 630 | 7/1970 | |
| DE | 89 04 001 U | 6/1989 | |
| DE | 39 32 340 A1 | 5/1990 | ..... 5/238 |
| DE | G 91 07 475 U1 | 11/1992 | |
| DE | 196 46 633 A1 | 10/1997 | |
| EP | 0 444 731 A | 9/1991 | ..... 5/236.1 |
| EP | 0 519 321 A | 12/1992 | |

*Primary Examiner*—Alexander Grosz
(74) *Attorney, Agent, or Firm*—Technoprop Colton LLC

(57) ABSTRACT

An underspringing arrangement having elongate bar elements (10) which have a multiplicity of mounts (20) for connecting slats (11) to the bar elements (10) making it possible for the position of the slats (11) to be changed by said slats being plugged, if required, into other mounts (12) of the bar elements (10). The underspringing arrangement also makes provision for the spring properties of the elastic bar elements (10) to be changed by additional springs (45) or filler elements (39). The underspringing arrangement may be provided as a single, specific underspringing arrangement in beds or may be arranged on a conventional underspringing arrangement for beds.

37 Claims, 7 Drawing Sheets

UNDERSPRINGING ARRANGEMENT FOR MATTRESSES OR THE LIKE AND USE THEREOF

BACKGROUND OF THE INVENTION

1. Technical Field

The invention relates to an underspringing arrangement for mattresses or the like having slats retained resiliently at opposite ends. The invention also relates to bar elements of such an underspringing arrangement and to uses of the underspringing arrangement.

2. Prior Art

Underspringing arrangements, which are intended for mattresses or the like of furniture for sleeping on, sitting on or lying on and have resilient slats which are mounted on fixed frame parts at opposite ends by way of elastic bearing bodies, are known. The slats are fastened on the frame at fixed, usually equal distances apart. Such known underspringing arrangements thus always subject the individual lying on the mattress or the like to approximately the same bearing forces. In the case of individuals who are forced, by age or illness, to lie in bed over relatively long periods of time, these result in problems—so-called bedsores.

BRIEF SUMMARY OF THE INVENTION

The object of the invention, then, is to provide an underspringing arrangement for mattresses and a use thereof which make it possible to avoid the occurrence of bedsores as a result of individuals (invalids and the elderly) being in a lying position over a relatively long period of time.

An underspringing arrangement for achieving the object mentioned above has slats retained resiliently at opposite ends. Accordingly, the underspringing arrangement has elastic bar elements which preferably run in the longitudinal direction of the mattress or the like and are intended for retaining the opposite ends of the slats. The bar elements comprise mounts for retaining the ends of the slats, and the number of mounts is larger than the number of slats of the underspringing arrangement. It is thus possible for the slats of the underspringing arrangement to be positioned as required.

One aspect of the underspringing arrangement, which may also be an independent solution for achieving the object of the invention, makes provision for the bar elements to be designed such that their elasticity can be changed. As a result, the force to which the mattress or the like—and thus the individual lying thereon—is subjected by the underspringing arrangement can be changed. The bar elements can preferably have their elasticity changed individually, in particular independently of one another, in the region of, that is, proximal to, at least some of the slats. The mounting of the slats on the bar elements may thus be adjusted to a more rigid or a more yielding state. It is also possible to change the local distribution of the bearing forces of an individual on the mattress even without changing the position of the slats in the longitudinal direction of the elastic bar elements.

Provision is also made for at least some of the slats to be assigned separate springs. The springs are preferably located at the end regions of the respective slats, said ends regions being connected to the bar elements. Accordingly, the springs are located in the regions of the bar elements where their effect is combined with the spring forces to which the ends of the slats are subjected by said bar elements. This makes it possible for the spring characteristics of the elastic bar elements to be configured on a more individual basis, or changed, at least in the regions of those slats which are assigned additional springs.

An elastic bar element for an underspringing arrangement for achieving the object mentioned in the introduction has a plurality of bar parts. Accordingly, each bar element is formed from a plurality of (short) bar sections, in particular bar parts, which can be coupled together one behind the other in the longitudinal direction. It is thus possible for an elastic bar element of any desired length to be formed from identical bar sections.

Provision is also made for the individual bar parts to be coupled together releasably for the purpose of forming the elastic bar elements, preferably such that the bar parts are connected to one another in a flexurally rigid manner, with the result that coupled-together bar parts produce continuous bar elements of any desired length.

A further elastic bar element for forming an underspringing arrangement for achieving the object mentioned in the introduction has two adjacent load-bearing legs. Accordingly, each bar element is formed from two adjacent load-bearing legs which are connected to one another by a web. This makes it possible for each bar element, in particular each bar part, to be produced in one piece by, for example, injection molding.

A preferred feature of the elastic bar element makes provision for the web for connecting the load-bearing legs to be designed as an elastic hinge. As a result, it is possible for the two load-bearing legs to be produced such that they are located in one plane and, following the production, to be moved into two parallel planes by being pivoted about the elastically designed web, with the result that a channel-like longitudinal groove is produced between the two load-bearing legs.

Provision is also made for a plurality of mounts which follow one after the other at a small distance apart in the longitudinal direction of each load-bearing leg, which are intended to retain an end region of each slat, and which are arranged on the top border of each load-bearing leg of the bar element. The resulting, relatively close succession of the mounts for end regions of the slats makes it possible for the bar elements to be assigned more mounts than are necessary, that is, there are more mounts in total per bar element than there are slats necessary for supporting the mattress or the like, as a result of which the slats can be plugged into different mounts as required and the distances between the slats can thus be adapted individually to an individual lying on a mattress above the underspringing arrangement.

Provision is also made for spring structures to be provided between each mount and the web connecting the underside of the parallel load-bearing legs. Said spring structures allow compliance compression of the entire slat when the mattress is loaded by an individual lying thereon.

It is preferably also the case that the mounts are connected to one another, preferably by upright mattress bearings. As a result, the borders of the mattresses, in the regions of the elastic bar elements, are kept at a slight distance above the slats, which is particularly advantageous if spring plates which follow one after the other at regular intervals are arranged on the slats as a bearing means for the mattresses.

BRIEF DESCRIPTION OF THE DRAWINGS

A preferred exemplary embodiment of the invention is explained in more detail hereinbelow with reference to the drawing, in which.

DETAILED DESCRIPTION OF THE PREFERRED EMBODIMENTS

The underspringing arrangement shown here serves for accommodating at least one mattress or the like of a bed or of a piece of furniture for lying on or sitting on.

The underspringing arrangement has two bar elements 10 which are spaced apart parallel to one another in the longitudinal direction of the bed or the like. The bar elements 10 are of identical design and bound opposite longitudinal borders of the underspringing arrangement. The underspringing arrangement also has a plurality of slats 11. The slats 11 which are designed identically to one another, are spaced apart parallel to one other in the direction transverse to the bar elements 10 and connect the latter. The slats 11 are connected to the bar elements 10 of the underspringing arrangement at opposite end regions. The underspringing arrangement also has resilient bearing plates 12 which are assigned to the slats 11 and only some of which are illustrated, schematically, in FIG. 1. Each slat 11 is assigned a plurality of bearing plates 12 preferably at uniform distances apart, the bearing plates 12 of adjacent slats 11 preferably being offset in relation to one another such that the bearing plates 12 of one slat 11 are staggered between the bearing plates 12 of the adjacent slat 11.

Figure 5:
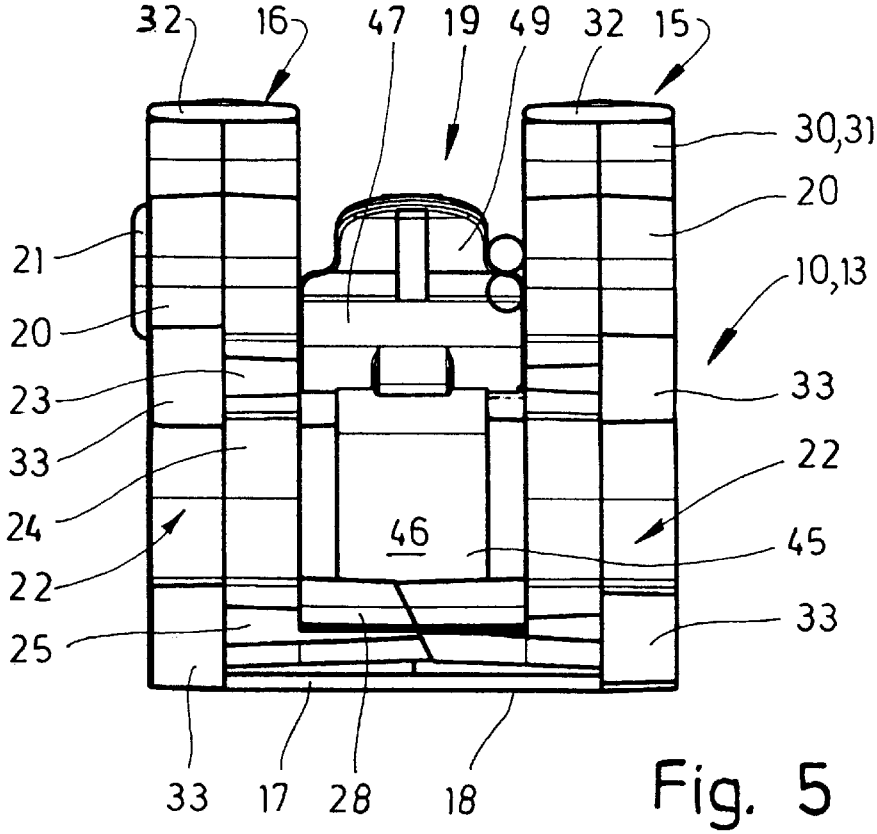
FIG. 5 shows an end view of a bar part from FIGS. 2 to 4.

Each of the identically designed bar elements 10 is formed from a certain number of identical bar parts 13, which are arranged one behind the other in the longitudinal direction of the respective bar element 10 and are connected to one another by in each case a plurality of releasable plug-in connections 14. Each of the identical bar elements 10 are of cross-sectionally U-shaped design (FIG. 5). Accordingly, each bar element 10 has two load-bearing legs 15, 16 which are spaced apart parallel to one another and run in a vertically directed manner in the longitudinal direction of the bar element 10. Opposite outer sides of the load-bearing legs 15, 16 bound vertical borders of the bar element 10. The two load-bearing legs 15, 16 of the bar element 10 are connected on their underside by a horizontal web 17. The web 17 thus forms an underside 18 of the respective bar element 10. The load-bearing legs 15, 16 are not connected to one another on the top, free borders. As a result, a channel-like longitudinal groove 19 which runs continuously in the longitudinal direction of the bar elements 10 is produced between the load-bearing legs 15, 16.

Figure 1:
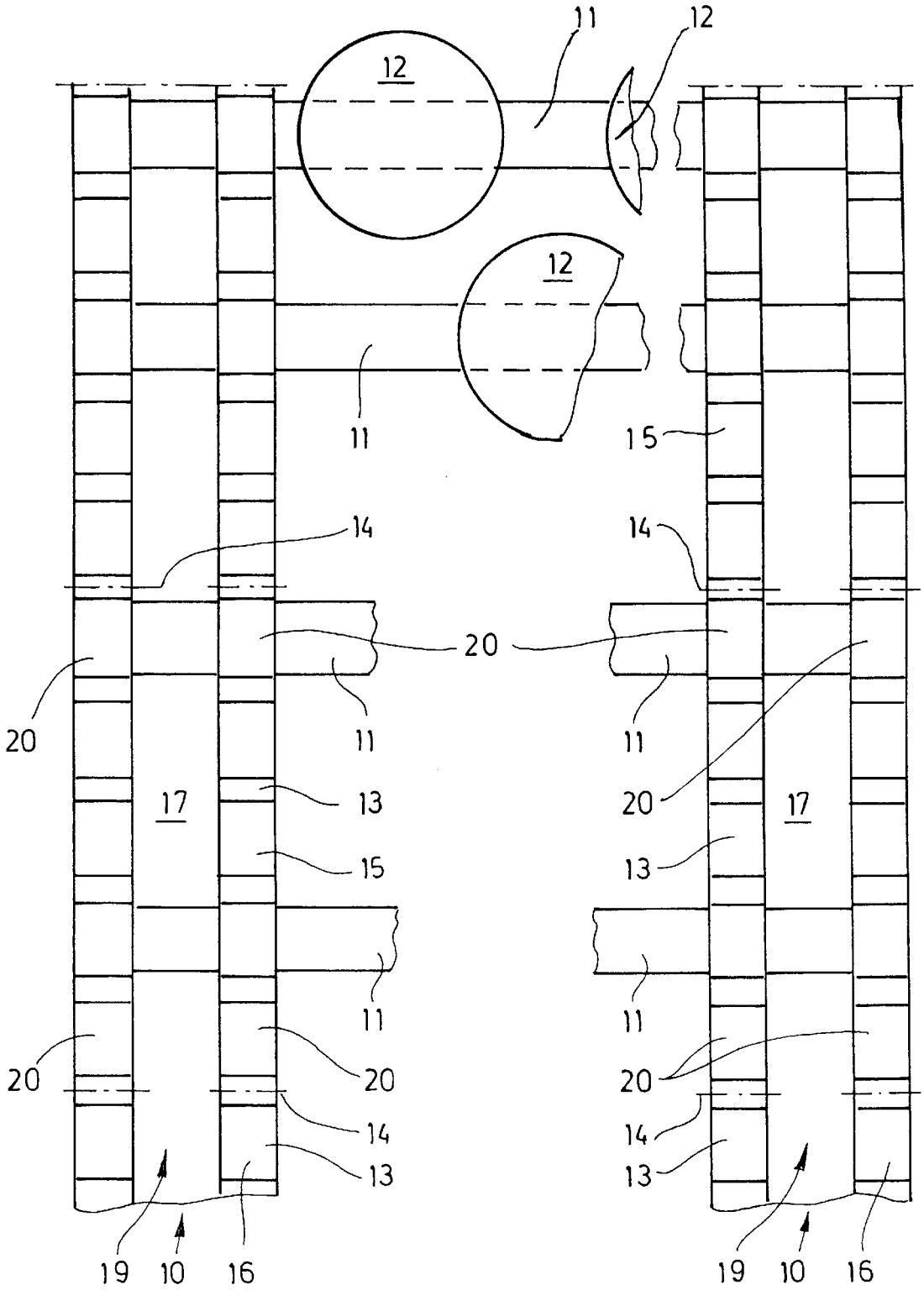
FIG. 1 shows a plan view of an underspringing arrangement of which part is illustrated in simplified form.
Figure 2:
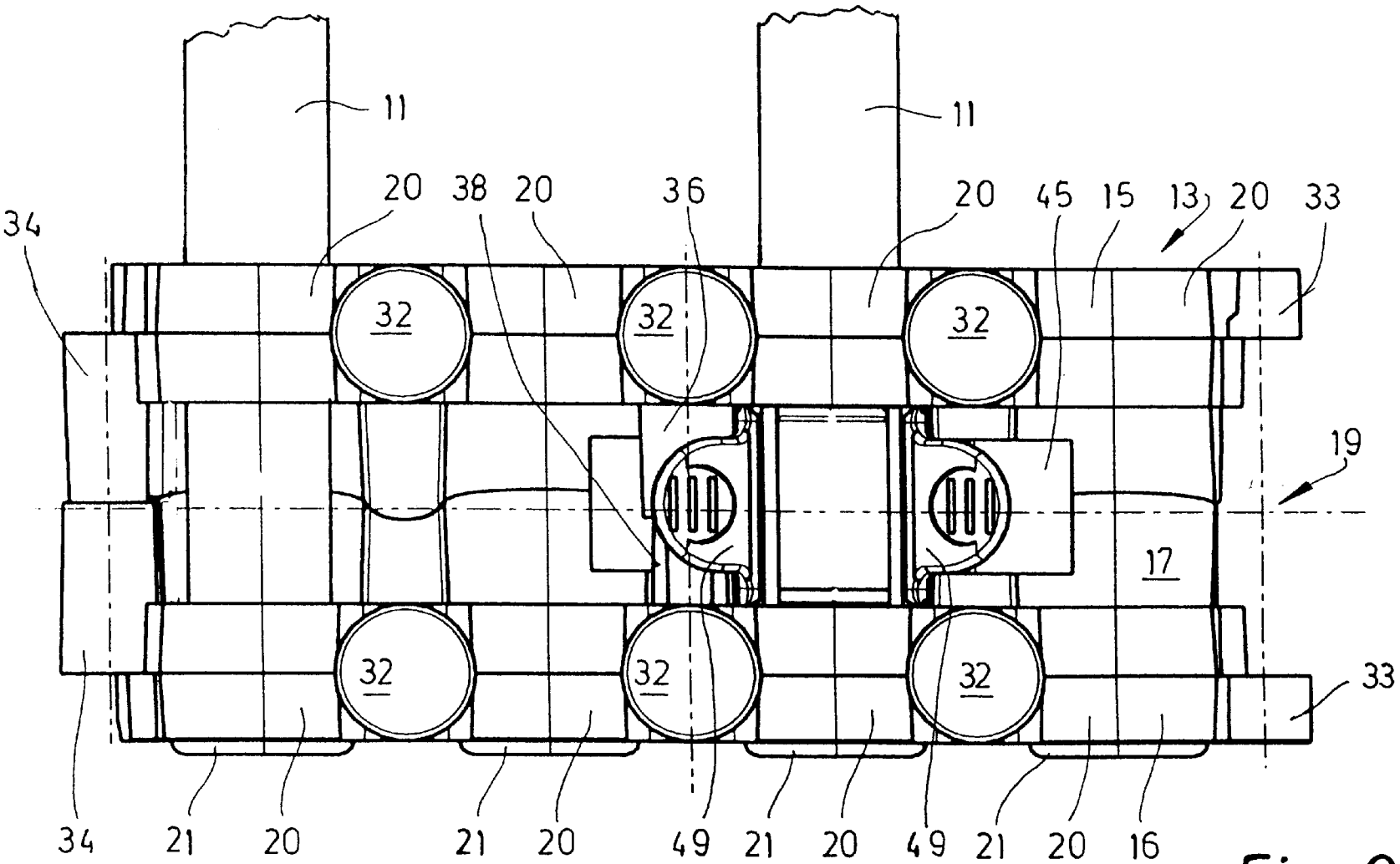
FIG. 2 shows a plan view of a bar part of a bar element of the underspringing arrangement.

Each of the essentially identically designed load-bearing legs 15, 16 of the bar element 10, or of the bar parts 13 which serve for forming the same, have a plurality of mounts 20. Mounts 20 cooperate with one end region of a slat 11, these being located in the same horizontal plane. The mounts 20 are arranged such that they follow one after the other in the longitudinal direction of the bar element 10 a small distance apart from each other, with the distances between two adjacent mounts 20, which also is the distance between two adjacent bar parts 13, preferably being equal in each case. In the exemplary embodiment shown, the distance between two mounts 20 is approximately half the size of the dimension of the respective mount 20 in the longitudinal direction of the bar element 10. As a result, the mounts 20 are spaced apart from one another by a comparatively small distance, which is smaller than the usual distance between adjacent slats 11. This makes it possible for the distance between the slats 11 to be changed as desired by the end regions of the slats 11 being plugged into various of the surplus mounts 20 (FIG. 1). Surplus mounts 20 in this context means that the number of mounts 20 following one after the other in the longitudinal direction of the bar element 10 is larger than the number of slats 11 necessary for forming the underspringing arrangement.

The mounts 20 are of sleeve-like design. In this case, they enclose the respective end region of a slat 11 with a form fit, said slat being pushed through an, in this case, oval cavity encased by the respective mount 20. The longitudinal center axis of the cavity of the respective mount 20 coincides with the longitudinal center axis of the respective slat 11 and is thus directed transversely to the direction of the longitudinal extent of the respective bar element 10. The mounts 20 on the mutually facing load-bearing legs 15 of the bar elements 10, which are spaced apart parallel to one another, of opposite longitudinal sides of the underspringing arrangement are open-ended, that is to say the respective end region of a slat 11 can be plugged through the annular mount 20 on the top sides of the load-bearing legs 15. In contrast, the mounts 20 of the outer load-bearing legs 16 are closed on the outer end side by an end wall 21. The end wall 21 serves as a stop for in each case one of the slats 11 pushed into the mounts 20 of the outer side walls. On account of the abovedescribed design of the mounts 20 and the formation of the bar element 10 from two parallel load-bearing legs 15, 16, the end region of each slat 11 in two spaced-apart mounts 20, namely of the load-bearing leg 15, on the one hand, and of the load-bearing leg 16, on the other hand, are connected to each bar element 10 and retained with a form fit therein.

Each mount 20, namely both of the inner load-bearing leg 15 and of the outer load-bearing leg 16 of each bar element 10, is assigned a preferably identical spring structure 22. In the exemplary embodiment shown, each spring structure 22 is formed from three tubular spring rings 23, 24, 25 which are located one above the other. A relatively large, central spring ring 24 is respectively assigned, on the top side and on the underside, in each case one relatively small, outer spring ring 23, 25. The spring rings 23, 24, 25 are connected integrally to one another at the locations of contact between their lateral surfaces. All three spring rings 23, 24, 25 have an oval or elliptical configuration, with the relatively small, outer spring rings 23, 25 being of narrower configuration than the relatively large, central spring rings 24.

Each top spring ring 23 is connected integrally on its top side to the respective mount 20. In contrast, each bottom spring ring 25 is connected integrally to the web 17. In this way, by means of each of the identical spring structures 22, the mount 20 assigned to the respective spring structure 22 is connected integrally to the web 17 in the vertical direction.

Figure 6:
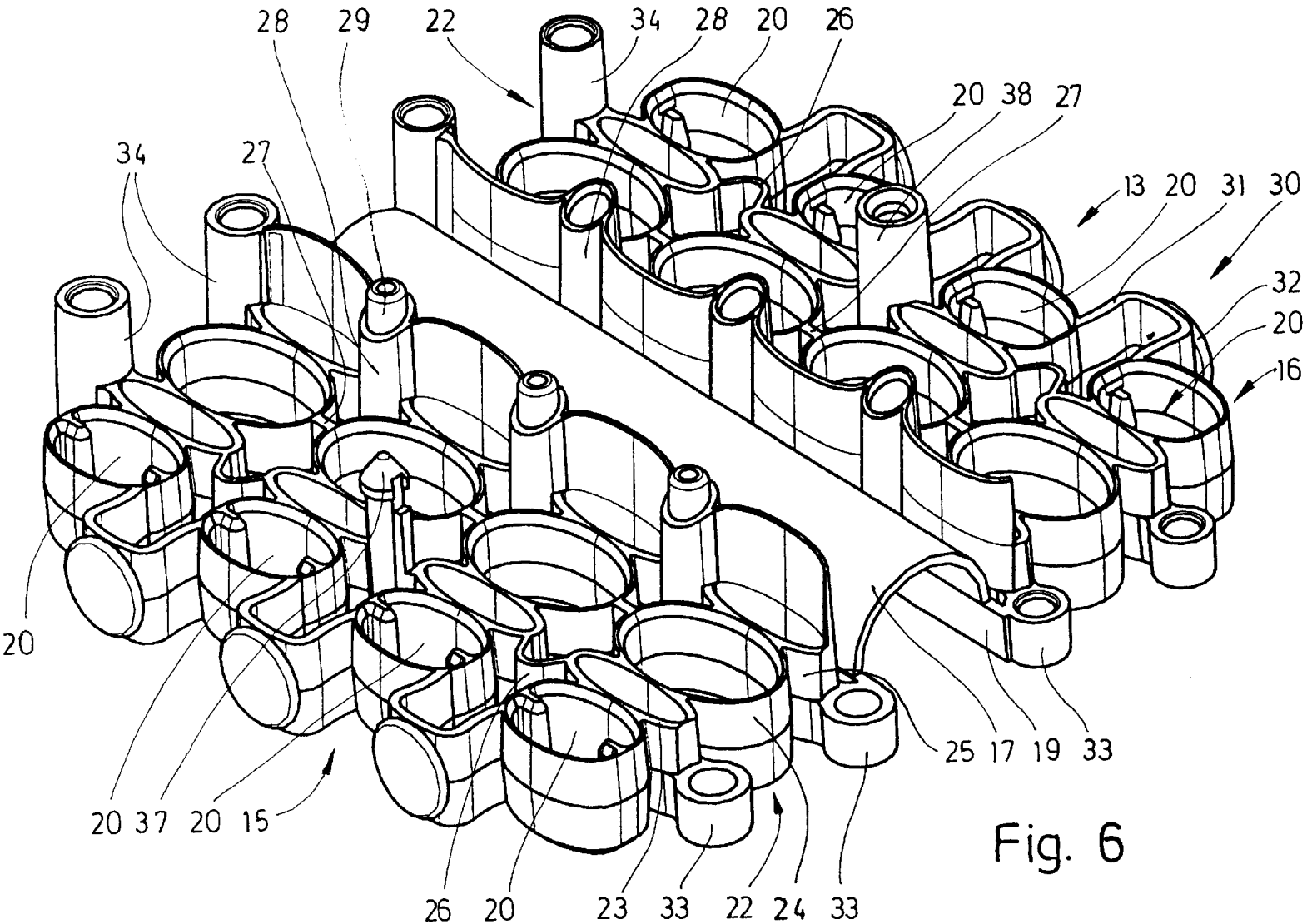
FIG. 6 shows a bar part in a production position illustrated in perspective.

The spring structures 22 are also connected in the horizontal direction, that is to say in the longitudinal direction of the respective bar element 10 and of the load-bearing leg 15, 16 for forming the same. This connection takes place by bridges 26, 27, 28 between the spring rings 23, 24, 25. The bridges 26 between the relatively small, top spring rings 23 are of U-shaped or V-shaped design, as a result of which the bridges 26 can be elastically deformed and the distance between the top spring rings 23 can thus be changed. The bridges 27 between the adjacent, relatively large spring rings 24 are designed as a planar, horizontal connecting web. The bridges 28 between the bottom spring rings 25 are of sleeve-like design. Said sleeve structure of the bridges 28 extends transversely over the web 17, to be precise through the longitudinal groove 19 between the load-bearing legs 15, 16 approximately to the center of the respective bar element 10. A free end of the sleeves extending from the load-bearing leg 16 of each bar element 10 is provided with a protrusion 29 (FIG. 6). The protrusions 29 engage in free end sides of the sleeves for the purpose of forming the bridges 28 of the adjacent load-bearing leg 15 (FIG. 5).

The adjacent mounts 20 of each bar part 13 are connected by a mattress bearing 30. The latter is formed by a load-bearing part 31 which is of U-shaped design, as seen transversely to the longitudinal direction of the bar element 10, and has upright legs which are connected to one another on their top side by a web, on which a cylindrical bearing surface 32 for a mattress or the like is provided. The bearing surface 32 is connected integrally to the U-shaped bracket of the load-bearing part 31. The U-shaped design of each load-bearing part 31 means that the bearing surfaces 32 are located at a distance above the mounts 20. This distance is selected such that the bearing surfaces 32 between all the mounts 20 are located in one horizontal plane, which corresponds approximately to the plane of the bearing plates 12 located on the slats 11.

In each case two bar parts 13, for forming a bar element 10, are connected to one another by two plug-in connections 14. The two plug-in connections 14 between two successive bar parts 13 are located at a distance one above the other. In the exemplary embodiment shown, the two plug-in connections 14 are designed similarly. Each plug-in connection 14 is formed from four bushings 33, 34 and a connecting pin 35. The plug-in connection 14 is produced in each case by the relevant connecting pin 35 being plugged through the bushings 33, 34 of two adjacent bar parts 13, said operation taking place in the horizontal direction transversely to the longitudinal extent of the respective bar element 10, and the two plug-in connections 14 located one above the other coupling together in each case two bar parts 13 in an essentially flexurally rigid manner.

Figure 3:
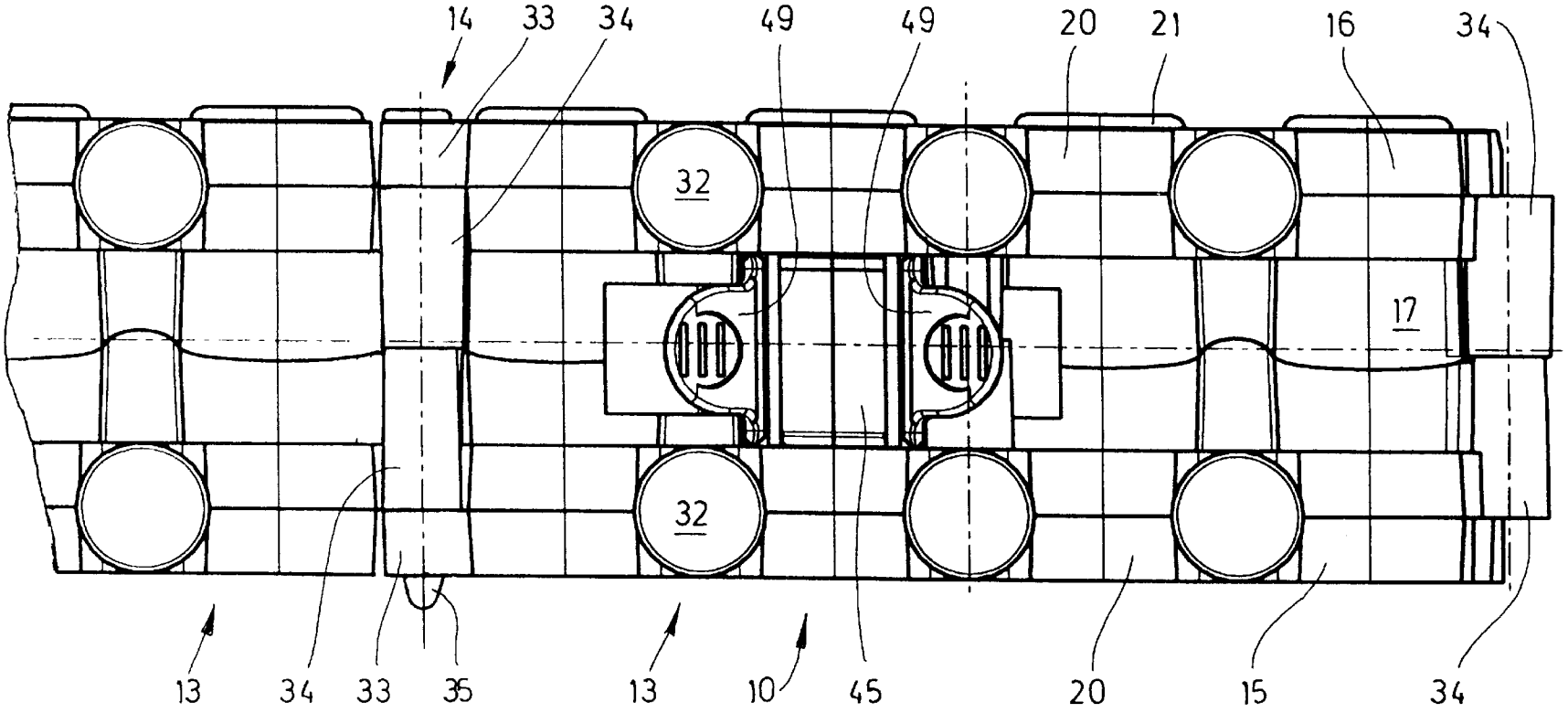
FIG. 3 shows a plan view of two interconnected bar parts for forming the bar elements.
Figure 4:
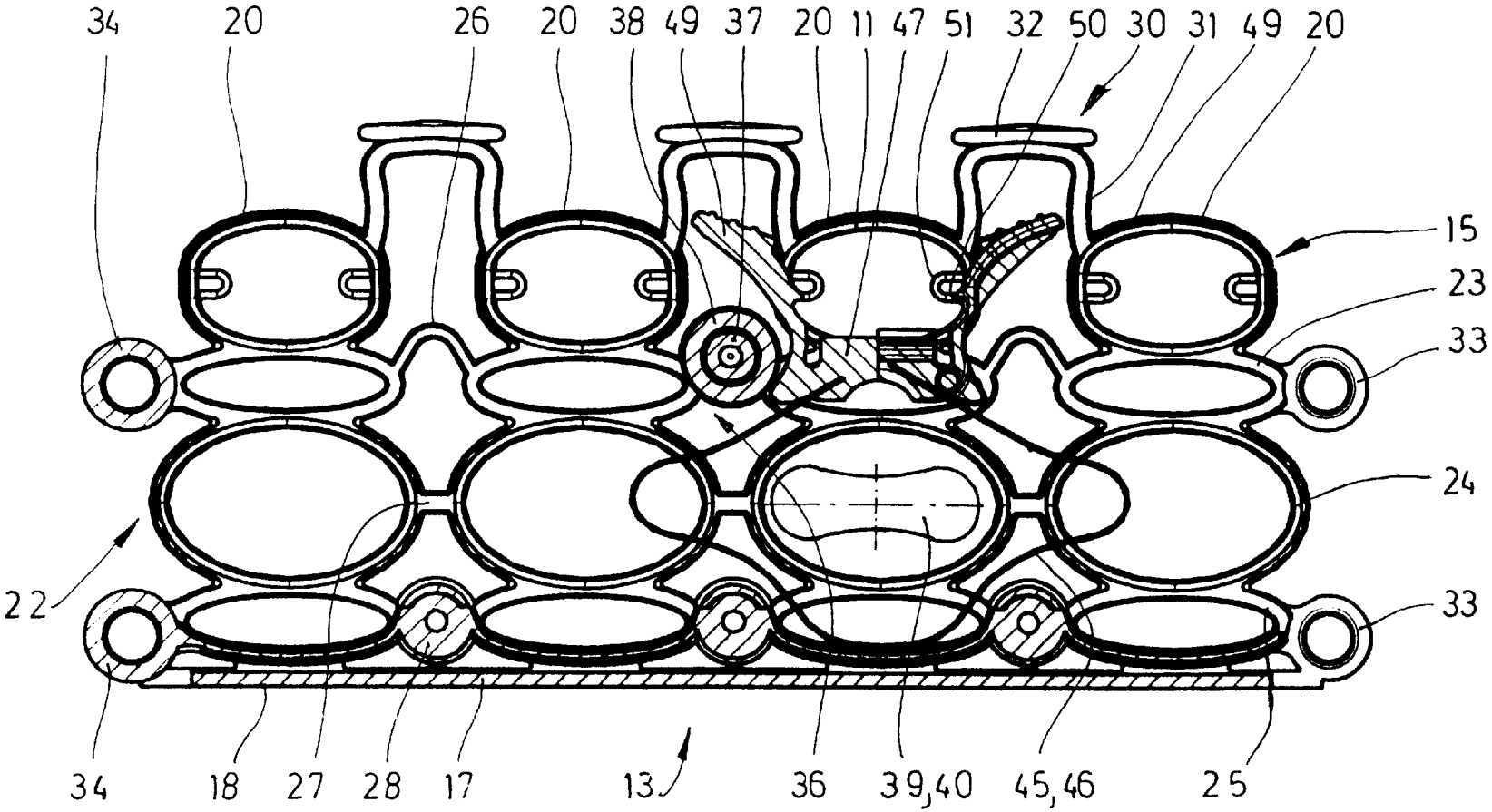
FIG. 4 shows a side view of a bar part from FIGS. 2 and 3.

The bushings 33, 34 of the top plug-in connections 14 are assigned to outer ends of the front and rear spring rings 23 of each bar part 13. In order to form the bottom plug-in connection 14, outer sides of the bottom spring rings 25 are assigned bushings 33, 34. The bushings 33, 34 at different ends of each bar part 13 are of different lengths and are spaced apart from one another by different distances. Bushings 33 arranged at one end of each bar part 13 are spaced apart from one another by such a distance on their mutually facing end sides that the closer-together bushings 34 at one end of an adjacent bar part 13 can engage therebetween. These bushings 34 are of such a length that their mutually facing end surfaces butt against one another along a vertical longitudinal center axis of the bar part 13. If adjacent bar parts 13 are connected in the region of the respective plug-in connection 14, then the inner, longer bushings 34 on one side of one bar part 13 and the adjacent outer, shorter bushing 33 of the other side of an adjacent bar part 13 extend over the entire width of the bar element 10 (FIG. 3). Furthermore, each bar part 13 has two bushings 34 on one side and two outer bushings 33 on the other side. This makes it possible for the bar elements 10 to be formed from identical bar parts 13 by the outer bushings 33 on one side of one bar part 13 being combined with the inner bushings 34 on the other side of the adjacent bar part 13 and by the bar parts 13 being coupled together to form the respective bar element 10 by virtue of the connecting pin 35 being plugged transversely through each plug-in connection 14.

The bushings 33, 34 have different internal diameters, respectively. Correspondingly, the connecting pin 35 is of slightly conical design in the longitudinal direction and is provided with a thickened portion at the end. The connecting pin 35 can be pushed through the larger diameter bushings 34 by way of the thickened portion without meeting any resistance. In contrast, the thickened portion at the free end of the connecting pin 35 can only be pushed through, in particular, the smaller-diameter outer bushing 33 with widening of the latter, as result of which, once the connecting pin 35 has been plugged through all the bushings 33, 34 to the full extent, said pin is retained with a form fit in the smaller-diameter outer bushing 33.

Each bar part 13 has, approximately centrally, an additional connecting element 36 between the load-bearing legs 15, 16. This connecting element 36 is formed by a stub, which projects into the longitudinal groove 19 opposite the bridge 26 between two central top spring rings 23, and a corresponding sleeve 38 which, starting from the interspace between two top spring rings 23 of the opposite load-bearing leg 15, likewise extends into the longitudinal groove 19. The sleeve 38 and the stub 37 are dimensioned and designed such that their mutually facing end regions can be connected to one another with latching action, and the load-bearing legs 15 and 16 of the respective bar part 13 are thus held together in the center.

Each bar part 13 is formed in one piece from an elastic material, in particular an elastomer or a thermoplastic material having elastic properties, by injection molding. However, rather than the respective bar part 13 being injection molded in the use position, which is shown in FIGS. 2 to 5 and in which the load-bearing legs 15, 16 are spaced apart one beside the other in two different vertical planes, said injection molding takes place in a different, production position (FIG. 6). In this production position, the load-bearing legs 15, 16 have been swung apart from one another such that they are located one beside the other in a common plane. In this case, the load-bearing legs 15, 16 are connected by the web 17, which in the production position is curved in an arcuate manner (FIG. 6). The bar part 13 thus leaves its injection mold in the production position, which is shown in FIG. 6.

By virtue of the bar part 13 being formed from elastic deformable material, deformation of the web 17, which is curved during production and, in practice, forms an elastic hinge between the undersides of the load-bearing legs 15, 16, respectively, allows the load-bearing legs 15, 16 to be pivoted about opposite borders of the web 17 in order to move into the use position (FIGS. 2 to 5). This forces the load-bearing legs 15, 16 into a parallel position relative to one another, the web 17 being deformed such that it forms the approximately planar underside 18 of the respective bar part 13. Moreover, the longitudinal groove 19 between mutually facing inner sides of the load-bearing legs 15, 16 is produced by virtue of the load-bearing legs 15, 16 being erected and the web 17 being deformed. At the same time, as the load-bearing legs 15, 16 are erected, the latching connection between the stub 37 and the sleeve 38 of the connecting element 36 is produced. In this case, the protrusions of the bottom bridges 28 also engage in end-side depressions of adjacent parts of the bridges 28.

By virtue of the bar parts 13 being formed from a rubber-like material, the bar elements 10 are elastically deformable to a certain extent. The particular configuration of the bar elements 10, however, means that the latter can be deformed in a specific manner. The bar elements 10 are thus comparatively stiff in the longitudinal direction as a result of the double plug-in connections 14 between two bar parts 13 and the connection of the mounts 20 and of the spring rings 23, 24, 25 of the spring structures 22 to one another and as result of bridges 26, 27, 28.

However, as result of the spring structures 22, formed from spring rings 23, 24, 25, and beneath each mount 20, the bar elements 10 are elastically deformable in the vertical direction. The mounts 20 can thus be easily compressed. It is thus also possible for the slats 11 which are mounted in the bar elements 10 by way of their opposite end regions, to move downwards in their entirety. The slats 11 are thus mounted in a resiliently compliant manner on the bar elements 10.

The slats 11 are formed from comparatively stiff material, for example from glass-fiber-reinforced plastic. The slats 11 thus do not bow in practice. However, it is also conceivable to use yielding resilient slats.

Figure 9:
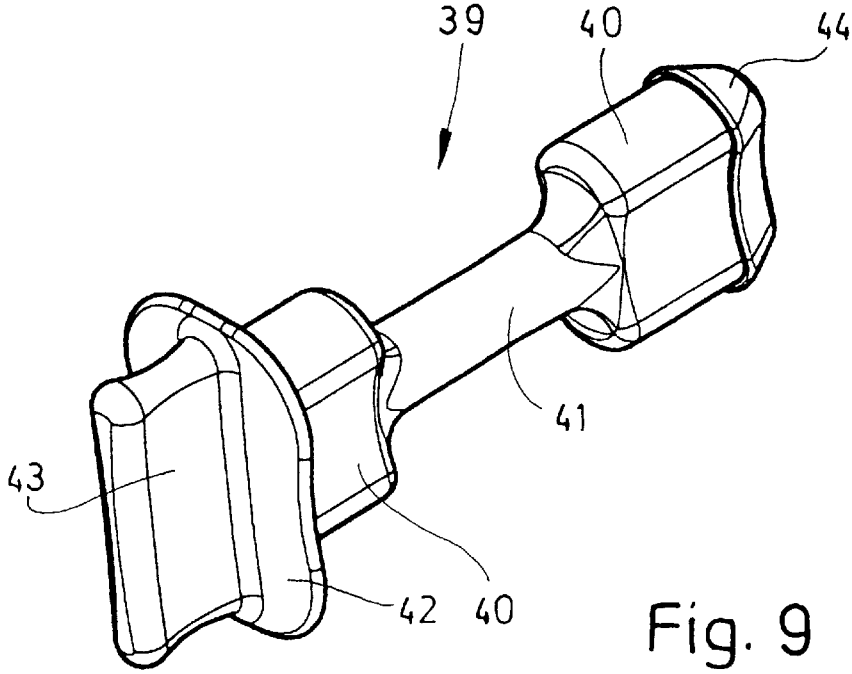
FIG. 9 shows a filler element illustrated in perspective.

Furthermore, the bar elements 10 are designed such that their spring properties can be changed. In the exemplary embodiment shown, filler elements 39 are used for this purpose (FIG. 9). Each filler element 39 has two spaced-apart flat filler bodies 40. A connecting rod 41 is arranged between the filler bodies 40. Provided at one end of one filler body 40 is a collar 42 which, on the outside, is connected to a projecting grip surface 43. The other filler body 40 is provided, on an end side, with a peripheral widened portion 44.

The filler element 39 is designed and dimensioned such that it can be plugged through the large oval spring rings 24 of the two load-bearing legs 15, 16 of the respective bar element 10. The spaced-apart filler elements 39 then extend in the region of the respective tubular spring ring 24 of the two load-bearing legs 15, 16 of the relevant bar element 10.

Furthermore, the filler bodies 40 of the filler element 39 are dimensioned such that, when the filler element 39 is located in the position shown in FIG. 9, with the filler bodies 40 and grip surface 43 upright, the spring rings 24 are widened slightly in the vertical direction or at least cannot be compressed any further beyond the position shown in the figures. With the vertical alignment of the filler bodies 40 that is shown in FIG. 9, the respective slat 11, beneath which the filler element 39 is arranged, that is to say the latter is located in the spring ring 24 beneath the respective slat 11, is mounted on the bar element 10 with the highest possible level of rigidity. The rigidity of this mounting can be reduced by the filler element 39 being rotated slightly out of the position shown in FIG. 9, in which the filler bodies 40 are aligned vertically. The more the filler element 39 is rotated in this way, the more yielding is the resilience of the respective slat 11. If, finally, the filler element 39 is rotated to the extent where the grip surface 43 and the filler bodies 40 are aligned horizontally (rotated through 90° in relation to the illustration in FIG. 9), the spring rings 24 can be compressed, without being influenced in any way by the filler element 39. In this case, the relevant slat 11 is mounted in a particularly yielding manner on the bar elements 10.

If the filler element 39 is located in a position in which the grip surface 43 and the filler bodies 40 are aligned horizontally, the filler element 39 can be drawn out of the spring ring 24 and, if required, pushed into another spring ring 24. Since only some of the slats 11 and/or certain slats 11 are assigned a filler element 39, the rigidity of the underspringing arrangement can be adjusted individually such that only certain parts of the body of the individual lying on a mattress above the underspringing arrangement are subjected to pressure loading in accordance with requirements or needs.

Other possible ways of changing the spring properties of the bar elements 10 are also conceivable. For example, instead of the rigid filler elements 39, use may be made of elastic filler bodies which can also be plugged through the large spring rings 24 of the load-bearing legs 15, 16. The resilient properties of the bar elements 10 are maintained by the elasticity of the filler bodies. Only the spring rigidity of said bar elements is increased. It is also conceivable for the filler elements 39 to be replaced by pneumatic filler bodies. In the simplest case here, these may be sack like sheaths with flexurally slack walls, the interior of which is filled with a gas, in particular air. In the simplest case, the gas or air filling of the air sacks can be hermetically sealed towards the outside. The resilient behavior of each air sack is thus essentially identical. However, it is also conceivable for the air sacks to be provided with valves, which make it possible to change the air pressure in the interior.

Figure 7:
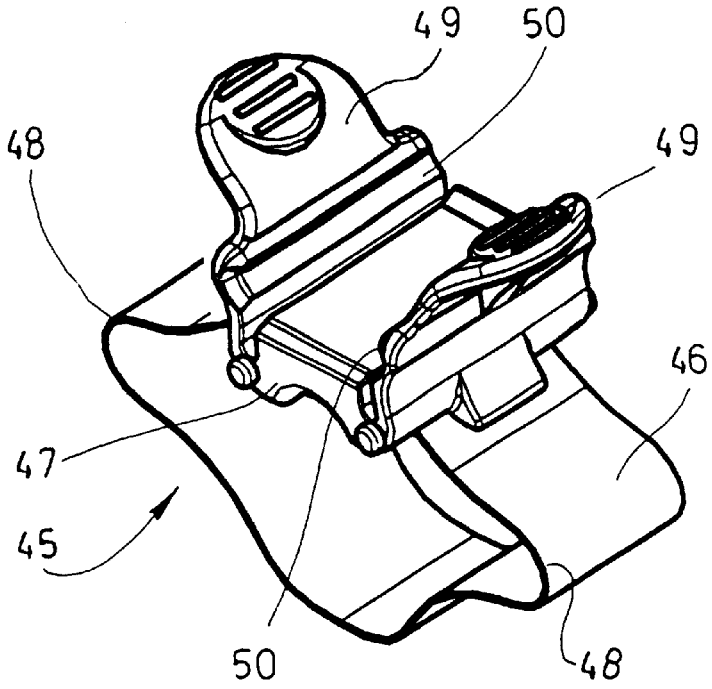
FIG. 7 shows a spring illustrated in perspective.
Figure 8:
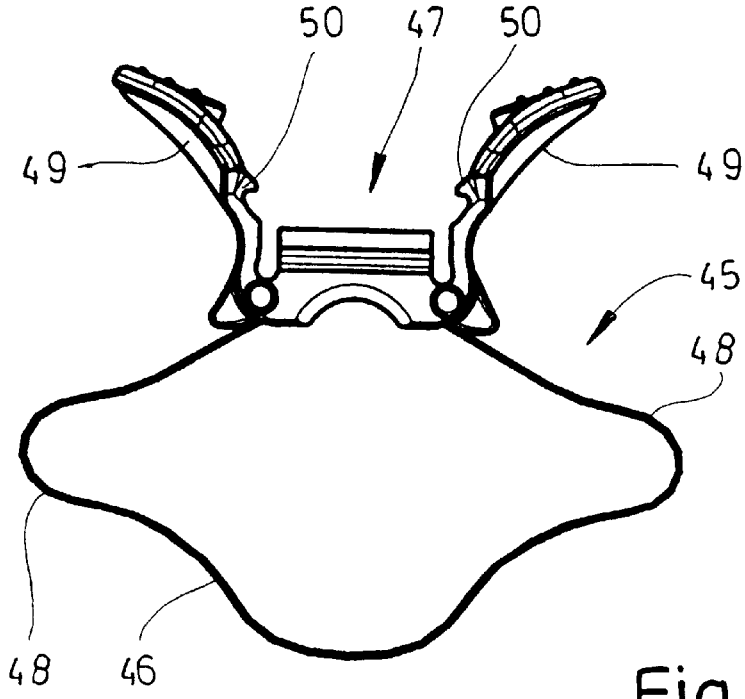
FIG. 8 shows an end view of the spring from FIG. 7.

Provision is also made for at least some of the slats 11 in particular selected slats 11 to be assigned additional springs 45. These springs 45 (FIGS. 7 and 8) are designed such that they are accommodated in the longitudinal groove 19 of the respective bar element 10. The springs 45 are designed such that they can be connected to the end region of the respective slat 11, which is located between the adjacent load-bearing legs 15, 16 of the respective bar element 10, and are supported on the web 17.

Each spring 45 is formed from a spring sheet 46 and a spring head 47. The spring sheet 46, formed from spring steel, has the progression shown in FIG. 8, with pronounced lateral convexities 48 which are dimensioned such that the spring 45 has the desired spring rigidity. The spring head 47, which is formed from plastic, is molded on at the top of the spring sheet 46, with the result that the two are connected to one another and top, free ends of the spring sheet 46 are held together by the spring head 47, the latter thus closing the spring sheet to form a closed structure.

On the top side, the spring head 47 has two opposite, arcuate latching noses 49. The latching noses 49 engage around opposite regions of the respective end of a slat 11. In this case, a projecting latching ridge 50 on each latching nose 49 comes into form-fitting engagement with a groove 51 on each side of the slat 11. The additional springs 45 may be assigned to opposite end regions of all the slats 11 or else of just some of the slats 11. Those slats 11 which are assigned springs 45 at opposite ends achieve different spring characteristics as a result of the springs 45, said spring characteristics combining with the spring characteristics of the spring structures 22 integrated in the bar elements 10. By virtue of filler elements 39 being arranged in the spring rings 24 beneath certain slats 11 it is likewise possible for the spring characteristics of said slats 11 to be changed by the filler elements 39 being rotated such that they more or less prevent compression of the spring rings 25 or even spread the spring rings 24 apart from one another if the filler elements 39 are located in the upright position, which is shown in FIG. 9.

The underspringing arrangement described preferably serves for preventing bedsores. In particular individuals who are bed-ridden over a long period of time (invalids and the elderly) tend to suffer from bedsores if the same parts of their body rest on a mattress, and these parts of their body are thus predominantly subjected to pressure loading over a relatively long period of time. The underspringing arrangement according to the invention makes it possible for the parts of the individual's body which are subjected to pressure loading to be changed by the rigidity of the resilience of the slats 11 being changed by different positioning of the filler elements 39 and/or by different adjustment of the same. In addition, or as an alternative, it is possible, for the same purpose, to change the position of the slats 11 by plugging the latter into different mounts 20 of the bar elements 10.

The underspringing arrangement shown here may be arranged as a single underspringing arrangement directly on the substructure of a bed, of a piece of furniture for lying on or even of a piece of furniture for sitting on. This preferably takes places such that the bar elements 10 are supported, by way of their undersides 18, on longitudinal members or other supporting elements of a bed or of a piece of furniture for lying on or sitting on.

However, it is also conceivable for the above-described underspringing arrangement according to the invention to be arranged on an underspringing arrangement of a conventional bed, or of a piece of furniture for lying on or sitting on. In this case, the lateral bar elements 10 are located, by way of their undersides 18, on opposite longitudinal borders of, for example, conventional slatted bases in a bed or the like.

List of Designations

| | |
|---|---|
| 10 | Bar element |
| 11 | Slat |
| 12 | Bearing plate |
| 13 | Bar part |
| 14 | Plug-in connection |
| 15 | Load-bearing leg |
| 16 | Load-bearing leg |
| 17 | Web |
| 18 | Underside |
| 19 | Longitudinal groove |
| 20 | Mount |
| 21 | End wall |
| 22 | Spring structure |
| 23 | Spring ring |
| 24 | Spring ring |
| 25 | Spring ring |
| 26 | Bridge |
| 27 | Bridge |
| 28 | Bridge |
| 29 | Protrusion |
| 30 | Mattress bearing |
| 31 | Load-bearing part |
| 32 | Bearing surface |
| 33 | Bushing |
| 34 | Bushing |
| 35 | Connecting pin |
| 36 | Connecting element |
| 37 | Stub |
| 38 | Sleeve |
| 39 | Filler element |
| 40 | Filler body |
| 41 | Connecting rod |
| 42 | Collar |
| 43 | Grip surface |
| 44 | Widened portion |
| 45 | Spring |
| 46 | Spring sheet |
| 47 | Spring head |
| 48 | Convexity |
| 49 | Latching nose |
| 50 | Latching ridge |
| 51 | Groove |

What is claimed is:

1. An elastic bar element (10) for an underspringing arrangement for mattresses, the undersringing arrangement having slats (11) spring mounted at either end, wherein the elastic bar element (10) comprises a plurality of spring mounts (20) into which the ends of the slats (11) are inserted thus providing for the suspension of the mattress, and a plurality of bar parts (13) that can be coupled together one behind the other in the longitudinal direction of the bar elements (10).

2. The bar element according to claim 1, characterized in that the bar parts (13) can be coupled together in a flexurally rigid manner.

3. The bar element according to claim 1, characterized in that the bar parts (13) can be connected releasably to one another.

4. The bar element according to claim 1, characterized in that all the bar parts (13) are identical in design.

5. The bar element according to claim 1, characterized in that two bar parts (13) are connected adjacently to one another by at least two separate connections.

6. The bar element according to claim 5, characterized in that all the connections are plug-in connections (14).

7. An elastic bar element (10) for an underspringing arrangement for mattresses, the elastic bar element (10) having a plurality of bar parts (13) that can be coupled together one behind the other in the longitudinal direction of the bar elements (10), characterized in that two bar parts (13) are connected adjacently to one another by at least two separate plug-in connections (14), and in that each plug-in connection (14) is formed from bushings (33, 34) and a separate connecting pin (35), wherein the separate connecting pin (35) connects the bushings (33, 34) on the first of the bar parts (13) to the bushings (33, 34) on the second of the bar parts (13).

8. An elastic bar element for an underspringing arrangement for mattresses, the elastic bar element (10) having a plurality of bar parts (13) that can be coupled together one behind the other in the longitudinal direction of the bar elements (10), characterized in that two bar parts (13) are connected adjacently to one another by at least two separate plug-in connections (14) and in that, each of the bar parts (13) has, at opposite ends, bushings (33, 34) that have different dimensions from each other and/or are positioned relative to each other such that, when the first of the bar parts (13) is connected to the second of the bar parts (13), the bushings (33, 34) of the first of the bar parts (13) correspond with the bushings (33, 34) of the second of the bar parts (13) such that the bushings (33, 34) of each of the bar parts (13) are aligned with one another in the direction running transversely to the longitudinal direction of the bar element and a connecting pin (35) runs through all of the bushings (33, 34) between the two adjacent bar parts (13).

9. An elastic bar element for an underspringing arrangement for mattresses, the elastic bar element having two adjacent load-bearing legs (15, 16) that are connected to one another by at least one web (17), characterized in that the load-bearing legs (15, 16) are spaced apart and are parallel to one another.

10. The bar element according to claim 9, characterized by the bar elements are manufactured from a resilient material selected from the group consisting of elastomers and thermoplastics.

11. The underspringing arrangement for mattresses according to claim 9, characterized in that the underspringing arrangement is used as a means for preventing bedsores.

12. The underspringing arrangement for mattresses according to claim 11, characterized in that the underspringing arrangement is used as a bearing means on a base for mattresses.

13. An elastic bar element for an underspringing arrangement for mattresses, the elastic bar element having two adjacent load-bearing legs (15, 16) that are connected to one another by at least one web (17), characterized in that the load-bearing legs (15, 16) each comprise an underside and are connected integrally to one another on their underside by the web (17).

14. The bar element according to claim 13, characterized in that the bar elements are manufactured from a resilient material selected from the group consisting of elastomers and thermoplastics.

15. The underspringing arrangement for mattresses according to claim 13, characterized in that the underspringing arrangement is used as a means for preventing bedsores.

16. The underspringing arrangement for mattresses according to claim 15, characterized in that the underspringing arrangement is used as a bearing means on a base for mattresses.

17. An elastic bar element for an underspringing arrangement for mattresses, the elastic bar element having two adjacent load-bearing legs (15, 16) that are connected to one another by at least one web (17), characterized in that the load-bearing legs (15, 16) are connected to one another by at least one plug-in bridge (26, 27, 28).

18. The bar element according to claim 17, characterized in that the bar elements are manufactured from a resilient material selected from the group consisting of elastomers and thermoplastics.

19. The underspringing arrangement for mattresses according to claim 17, characterized in that the underspringing arrangement is used as a means for preventing bedsores.

20. The underspringing arrangement for mattresses according to claim 19, characterized in that the underspringing arrangement is used as a bearing means on a base for mattresses.

21. An elastic bar element for an underspringing arrangement for mattresses, the elastic bar element having two adjacent load-bearing legs (15, 16) that are connected to one another by at least one web (17), characterized in that each load-bearing leg (15, 16) comprises a free top border comprising a series of spring mounts (20) placed in the longitudinal direction of the load-bearing leg (15, 16), wherein the spring mounts (20) retain ends of slats (11).

22. The bar element according to claim 21, characterized in that the spring mounts (20) are spaced a small distance apart from each other in the longitudinal direction of the respective load-bearing leg (15, 16).

23. The bar element according to claim 21, characterized in that the spring mounts (20) are aligned one behind the other in the longitudinal direction of the slats (11) such that one end of each of the slats (11) is retained in two adjacent spring mounts (20) of different load-bearing legs (15, 16).

24. The bar element according to claim 21, characterized in that the bar elements are manufactured from a resilient material selected from the group consisting of elastomers and thermoplastics.

25. The underspringing arrangement for mattresses according to claim 21, characterized in that the underspringing arrangement is used as a means for preventing bedsores.

26. The underspringing arrangement for mattresses according to claim 25, characterized in that the underspringing arrangement is used as a bearing means on a base for mattresses.

27. An elastic bar element for an underspringing arrangement for mattresses, the elastic bar element having two adjacent load-bearing legs (15, 16) that are connected to one another by at least one web (17), characterized in that a spring structure (22) made of at least one tubular spring ring (23, 24, 25) is arranged beneath at least some spring mounts (20).

28. The bar element according to claim 27, characterized in that the spring structures (22) are formed from a large spring ring (24) and two small spring rings (23, 25), wherein the first small spring ring (23) is arranged above the large spring ring (24) and the second small spring ring (25) is arranged beneath the large spring ring (24).

29. The bar element according to claim 28, characterized in that the spring rings (23, 24, 25) of each of the spring structures (22) are vertically connected to one another, wherein the first small spring ring (23) is connected to one of the spring mounts (20) that is located thereabove, and the second small spring ring (25) is connected to the web (17) located therebeneath.

30. The bar element according to claim 28, characterized in that at least two of the spring structures (22) are located adjacent to each other and the spring rings (23, 24, 25) of the adjacent spring structures (22) are longitudinally connected to one another.

31. The bar element according to claim 27, characterized in that the bar elements are manufactured from a resilient material selected from the group consisting of elastomers and thermoplastics.

32. The underspringing arrangement for mattresses according to claim 27, characterized in that the underspringing arrangement is used as a means for preventing bedsores.

33. The underspringing arrangement for mattresses according to claim 32, characterized in that the underspringing arrangement is used as a bearing means on a base for mattresses.

34. An elastic bar element for an undespringing arrangement for mattresses, the elastic bar element having two adjacent load-bearing legs (15, 16) that are connected to one another by at least one web (17), characterized in that the load-bearing legs further comprise spring mounts (20), wherein the spring mounts (20) follow one after the other in the longitudinal direction of load-bearing legs (15, 16) and are connected to one another by mattress bearings (30).

35. The bar element according to claim 34, characterized in that the bar elements are manufactured from a resilient material selected from the group consisting of elastomers and thermoplastics.

36. The underspringing arrangement for mattresses according to claim 34, characterized in that the underspringing arrangement is used as a means for preventing bedsores.

37. The underspringing arrangement for mattresses according to claim 36, characterized in that the underspringing arrangement is used as a bearing means on a base for mattresses.

* * * * *